US009696062B2

(12) United States Patent
Yamasaki et al.

(10) Patent No.: US 9,696,062 B2
(45) **Date of Patent: *Jul. 4, 2017**

(54) AIR CONDITIONING APPARATUS

(71) Applicant: DAIKIN INDUSTRIES, LTD., Osaka-shi, Osaka (JP)

(72) Inventors: Takahiro Yamasaki, Sakai (JP); Tsunehisa Sanagi, Sakai (JP); Naofumi Yokoyama, Sakai (JP); Takashi Kashihara, Sakai (JP); Akihiko Mori, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/687,185

(22) Filed: Apr. 15, 2015

(65) Prior Publication Data

US 2015/0300668 A1 Oct. 22, 2015

(30) Foreign Application Priority Data

Apr. 18, 2014 (JP) ..... 2014-086210

(51) Int. Cl.
*F24F 7/06* (2006.01)
*F24F 7/007* (2006.01)
(Continued)

(52) U.S. Cl.
CPC ..... *F24H 9/0073* (2013.01); *F24F 1/0059* (2013.01); *F24H 3/0411* (2013.01); *F24F 2221/34* (2013.01)

(58) Field of Classification Search
CPC ..... F24F 1/0022; F24F 1/0018; F24F 2203/1056; F24F 2203/106; F24F 2203/1064
(Continued)

(56) References Cited

U.S. PATENT DOCUMENTS

2005/0109054 A1* 5/2005 Eom ..... F24F 1/0007 62/286
2008/0070493 A1* 3/2008 Rimmer ..... F24F 1/0007 454/186
2008/0182500 A1* 7/2008 Jessen ..... B60H 1/00671 454/155

FOREIGN PATENT DOCUMENTS

IT EP 0097216 A1 * 1/1984 ..... F24D 5/12
JP 6-281194 A 10/1994
(Continued)

OTHER PUBLICATIONS

English translation of Abstract of JP07-280700A documnet.*

*Primary Examiner* — Helena Kosanovic
(74) *Attorney, Agent, or Firm* — Global IP Counselors, LLP

(57) ABSTRACT

An air conditioning apparatus includes a casing having intake and blow-out ports, a partition member dividing an interior of the casing, a heat exchanger, a centrifugal fan, and a heater. The centrifugal fan includes a bladed wheel having a plurality of rearward blades and sucks air existing in the heat exchanger compartment into the fan compartment through the fan entrance. The bladed wheel is mounted in the fan compartment such that a rotary shaft of the bladed wheel is oriented along an opening direction of the fan entrance and an opening direction of the blow-out port. The heater is mounted in a blow-out port opposed space. The blow-out port opposed space is a region opposed to the blow-out port within a fan downwind space. The fan downwind space is a space located on a downwind side of the bladed wheel within the fan compartment.

4 Claims, 12 Drawing Sheets

(51) Int. Cl.
*F24H 9/00* (2006.01)
*F24H 3/04* (2006.01)
*F24F 1/00* (2011.01)

(58) Field of Classification Search
USPC ..... 454/249
See application file for complete search history.

(56) References Cited

FOREIGN PATENT DOCUMENTS

| | | | | |
|---|---|---|---|---|
| JP | 07280700 | A | * | 10/1995 |
| JP | 2009-198141 | A | | 9/2009 |

* cited by examiner

AIR CONDITIONING APPARATUS

CROSS-REFERENCE TO RELATED APPLICATIONS

This application claims priority under 35 U.S.C. §119 to Japanese Patent Application No. 2014-086210, filed Apr. 18, 2014. The entire disclosure of Japanese Patent Application No. 2014-086210 is hereby incorporated herein by reference.

FIELD OF THE INVENTION

The present invention relates to an air conditioning apparatus, particularly to an air conditioning apparatus that a rearward bladed centrifugal fan is mounted in a fan compartment having a fan entrance bored in opposition to a blow-out port such that a rotary shaft of the centrifugal fan is oriented to an opening direction of the fan entrance and an opening direction of the blow-out port.

BACKGROUND INFORMATION

As described in Japan Laid-open Patent Application Publication No. H06-281194, an air conditioning apparatus has been produced so far that a rearward bladed centrifugal fan is mounted in a ventilation unit (a fan compartment) having a fan entrance bored in opposition to a blow-out port such that a rotary shaft of the centrifugal fan is oriented to an opening direction of the fan entrance and an opening direction of the blow-out port. On the other hand, as described in Japan Laid-open Patent Application Publication No. 2009-198141, an air conditioning apparatus equipped with a sirocco fan (a multi-bladed fan) has been produced in which a temperature regulation element (heating means) is mounted in the vicinity of a blow-out port of the sirocco fan.

SUMMARY

It can be herein assumed to mount such heating means as described in Japan Laid-open Patent Application Publication No. 2009-198141 in the vicinity of a blow-out port in such an air conditioning apparatus equipped with a centrifugal fan as described in Japan Laid-open Patent Application Publication No. H06-281194.

However, air, which is blown out by the centrifugal fan disposed such that the rotary shaft thereof is oriented to the opening direction of the fan entrance and the opening direction of the blow-out port, tends to swirl in a rotary direction of the bladed wheel and simultaneously flow along lateral parts of the casing when a casing is seen from a direction along the rotary shaft of the centrifugal fan. By contrast, the sirocco fan is disposed such that the rotary shaft thereof is oriented to a direction orthogonal to the opening direction of the blow-out port as described in Japan Laid-open Patent Application Publication No. 2009-198141. Hence, such an airflow tendency as described in Japan Laid-open Patent Application Publication No. H06-281194 does not appear. Consequently, it is preferable to mount heating means in consideration of the airflow tendency and enable efficient heating by the heating means in the air conditioning apparatus that the centrifugal fan is disposed such that the rotary shaft thereof is oriented to the opening direction of the fan entrance and the opening direction of the blow-out port.

It is an object of the present invention to enable efficient heating by heating means in an air conditioning apparatus that a rearward bladed centrifugal fan is mounted a fan compartment having a fan entrance bored in opposition to a blow-out port such that a rotary shaft of the centrifugal fan is oriented to an opening direction of the fan entrance and an opening direction of the blow-out port when the heating means is mounted in the vicinity of the blow-out port.

An air conditioning apparatus according to a first aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that is bored in opposition to the blow-out port and makes the heat exchanger compartment and the fan compartment communicate with each other. The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance and an opening direction of the blow-out port. Moreover, the air conditioning apparatus includes heating means mounted in a blow-out port opposed space, which is a region opposed to the blow-out port within a fan downwind space that is a space located on a downwind side of the bladed wheel within the fan compartment. Additionally, the heating means is disposed in a region close to a circumferential part of the casing within the blow-out port opposed space when seen from a direction along the rotary shaft.

As described above, the heating means is herein mounted in the blow-out port opposed space, and is also designed to be disposed in the region close to the circumferential part of the casing within the blow-out port opposed space when seen from the direction along the rotary shaft. With the construction, the heating means is herein interpreted as being mounted in consideration of a tendency that air blown out by the bladed wheel of the centrifugal fan flows along lateral parts of the casing.

Consequently, efficient heating is herein enabled when the heating means is mounted in the vicinity of the blow-out port.

An air conditioning apparatus according to a second aspect relates to the air conditioning apparatus according to the first aspect, and wherein the blow-out port is at least partially disposed in a position close to a blow-out port nearby lateral part, which is one of lateral parts of the casing that are disposed along the opening direction of the fan entrance and the opening direction of the blow-out port. Furthermore, the heating means includes first heating means disposed in a position close to the bladed wheel in a region located on a rearward side in a rotary direction of the bladed wheel within the blow-out port opposed space. Additionally, the heating means includes second heating means disposed in a position close to the blow-out port in a region located on a forward side in the rotary direction of the bladed wheel within the blow-out port opposed space.

As described above, at least a part of the blow-out port is herein designed to be disposed closely to the blow-out port nearby lateral part, and the first heating means is designed to be disposed closely to the bladed wheel in the region located on the rearward side in the rotary direction of the bladed wheel within the blow-out port opposed space, whereas the second heating means is designed to be disposed closely to the blow-out port in the region located on the forward side in the rotary direction of the bladed wheel within the blow-out port opposed space. Therefore, the first and second heating means are herein interpreted as being mounted in consideration of a swirling airflow in the rotary direction of the bladed wheel. Put differently, air blown out to the fan downwind space by the bladed wheel flows while swirling in the rotary direction of the bladed wheel. Hence, the air tends to flow and concentrate from the space located on the rearward side in the rotary direction of the bladed wheel to the space located on the forward side in the rotary direction of the bladed wheel in accordance with proximity to the blow-out port. Then in consideration of the aforementioned tendency, the first heating means is designed to be disposed closely to the bladed wheel in the region located on the rearward side in the rotary direction of the bladed wheel within the blow-out port opposed space, whereas the second heating means is designed to be disposed closely to the blow-out port in the region located on the forward side in the rotary direction of the bladed wheel within the blow-out port opposed space.

Consequently, more efficient heating is herein enabled when the heating means is mounted in the vicinity of the blow-out port.

An air conditioning apparatus according to a third aspect relates to the air conditioning apparatus according to the second aspect, and wherein the second heating means has a heating capacity larger than a heating capacity of the first heating means.

As described above, the heating capacity of the second heating means is herein set to be larger than that of the first heating means. Therefore, the first and second heating means, composing the heating means, are herein designed to be mounted correspondingly to regions for which different heating capacities are suitable, i.e., one region that is located closely to the blow-out port within the blow-out port opposed space and in which air flows at a high flow rate; and another region that is located closely to the bladed wheel within the blow-out port opposed space and in which air flows at a low flow rate. Put differently, due to the swirling flow in the rotary direction of the bladed wheel, air is likely to flow and concentrate from the space located on the rearward side in the rotary direction of the bladed wheel to the space located on the forward side in the rotary direction of the bladed wheel in accordance with proximity to the blow-out port. Accordingly, the flow rate of air tends to be higher in the space located on the forward side in the rotary direction of the bladed wheel than in the space located on the rearward side in the rotary direction of the bladed wheel. Then in consideration of the aforementioned tendency, the heating capacity of the second heating means disposed in the space located on the forward side in the rotary direction of the bladed wheel is set to be larger than that of the first heating means disposed in the space located on the rearward side in the rotary direction of the bladed wheel.

Consequently, efficient heating is herein enabled in accordance with the flow rate of air when the heating means is mounted in the vicinity of the blow-out port.

An air conditioning apparatus according to a fourth aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that is bored in opposition to the blow-out port and makes the heat exchanger compartment and the fan compartment communicate with each other. The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance and an opening direction of the blow-out port. Moreover, the air conditioning apparatus includes heating means mounted in a blow-out port opposed space, which is a region opposed to the blow-out port within a fan downwind space that is a space located on a downwind side of the bladed wheel within the fan compartment. Additionally, the heating means includes first heating means disposed in a position close to the bladed wheel within the blow-out port opposed space, and includes second heating means disposed in a position close to the blow-out port within the blow-out port opposed space. The second heating means herein has a heating capacity larger than a heating capacity of the first heating means.

As described above, the heating means is herein designed to be mounted in the blow-out port opposed space, and specifically, the first heating means is disposed in the position close to the bladed wheel within the blow-out port opposed space whereas the second heating means, having a heating capacity larger than that of the first heating means, is disposed in the position close to the blow-out port within the blow-out port opposed space. Put differently, air blown out to the fan downwind space by the bladed wheel flows while swirling in the rotary direction of the bladed wheel. The swirling airflow tends to be weakened in accordance with proximity to the blow-out port, whereas the straight airflow toward the blow-out port tends to be strengthened. However, from the perspective of heating efficiency by the heating means, a state of airflow strengthened in a straight direction is more preferable than a state of airflow strengthened in a swirling direction. Therefore, in consideration of the aforementioned tendency, the first and second heating means, composing the heating means, are designed to be mounted correspondingly to regions for which different heating capacities are suitable, i.e., one region that is located closely to the blow-out port within the blow-out port opposed space and in which the straight airflow is strengthened; and another region that is located closely to the bladed wheel within the blow-out port opposed space and in which the swirling airflow is strengthened.

Consequently, efficient heating is herein enabled when the heating means is mounted in the vicinity of the blow-out port.

BRIEF DESCRIPTION OF THE DRAWINGS

Referring now to the attached drawings which form a part of this original disclosure.

DETAILED DESCRIPTION OF EMBODIMENTS

An air conditioning apparatus according to a preferred embodiment of the present invention will be hereinafter explained on the basis of the attached drawings. It should be noted that a specific construction of the air conditioning apparatus according to the present invention is not limited to the following preferred embodiment and the modifications thereof, and can be changed without departing from the scope of the present invention.

(1) Basic Construction of Air Conditioning Apparatus

Figure 1:
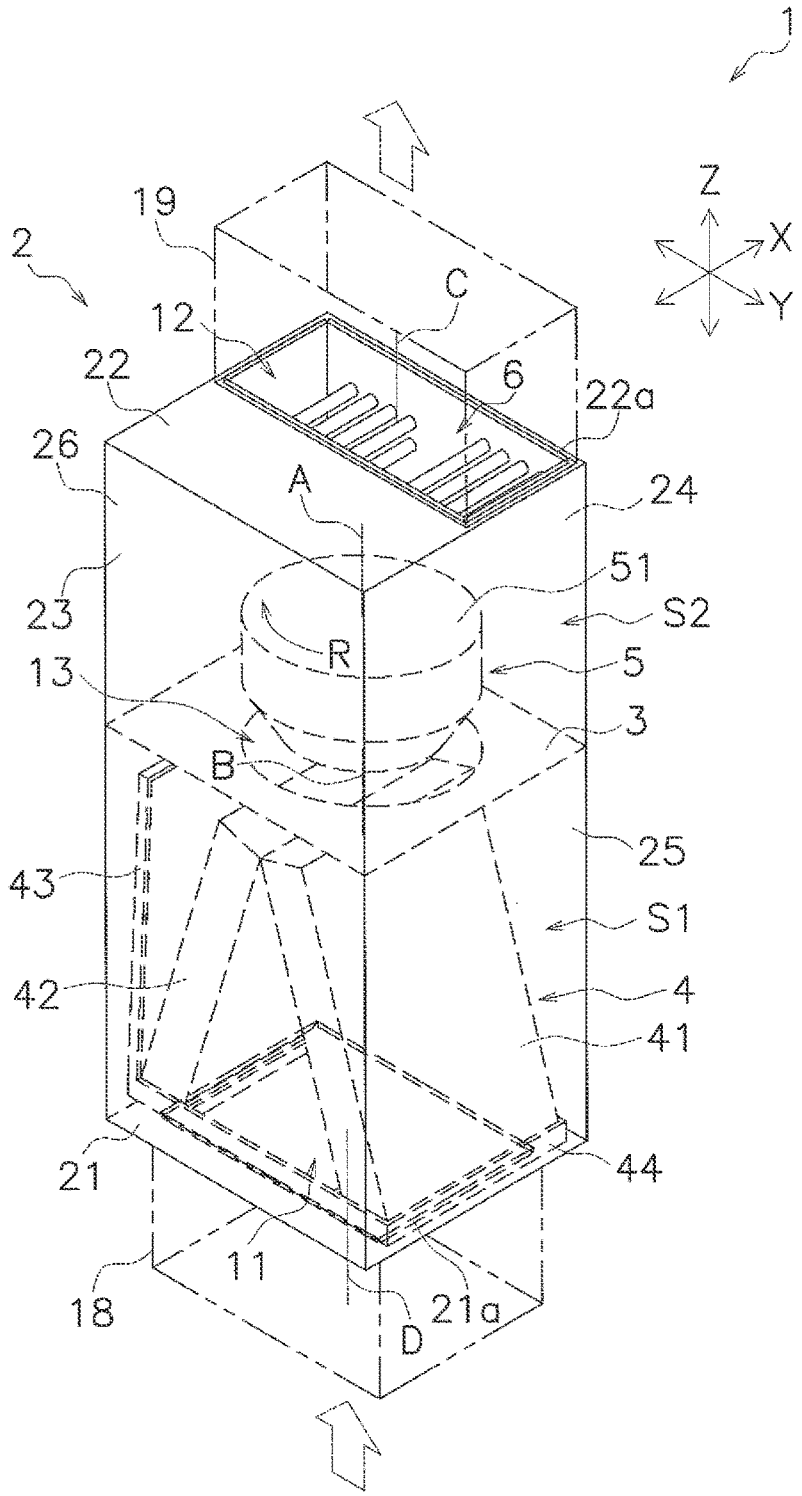
FIG. 1 is an external perspective view of an air conditioning apparatus according to a preferred embodiment of the present invention (in a vertical mount configuration)
Figure 2:
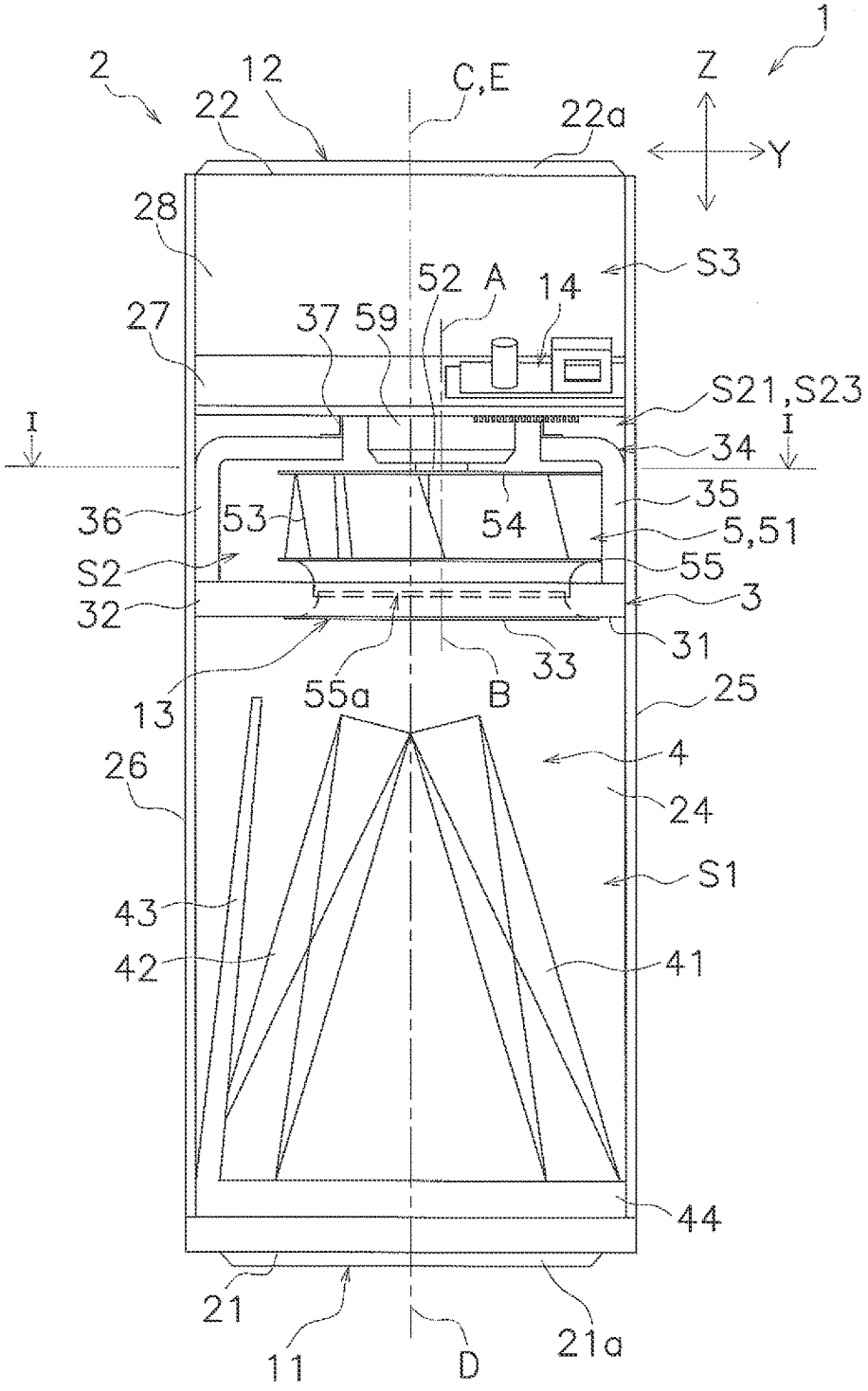
FIG. 2 is a front lateral view of the air conditioning apparatus from which a first lateral part is detached (in the vertical mount configuration)
Figure 3:
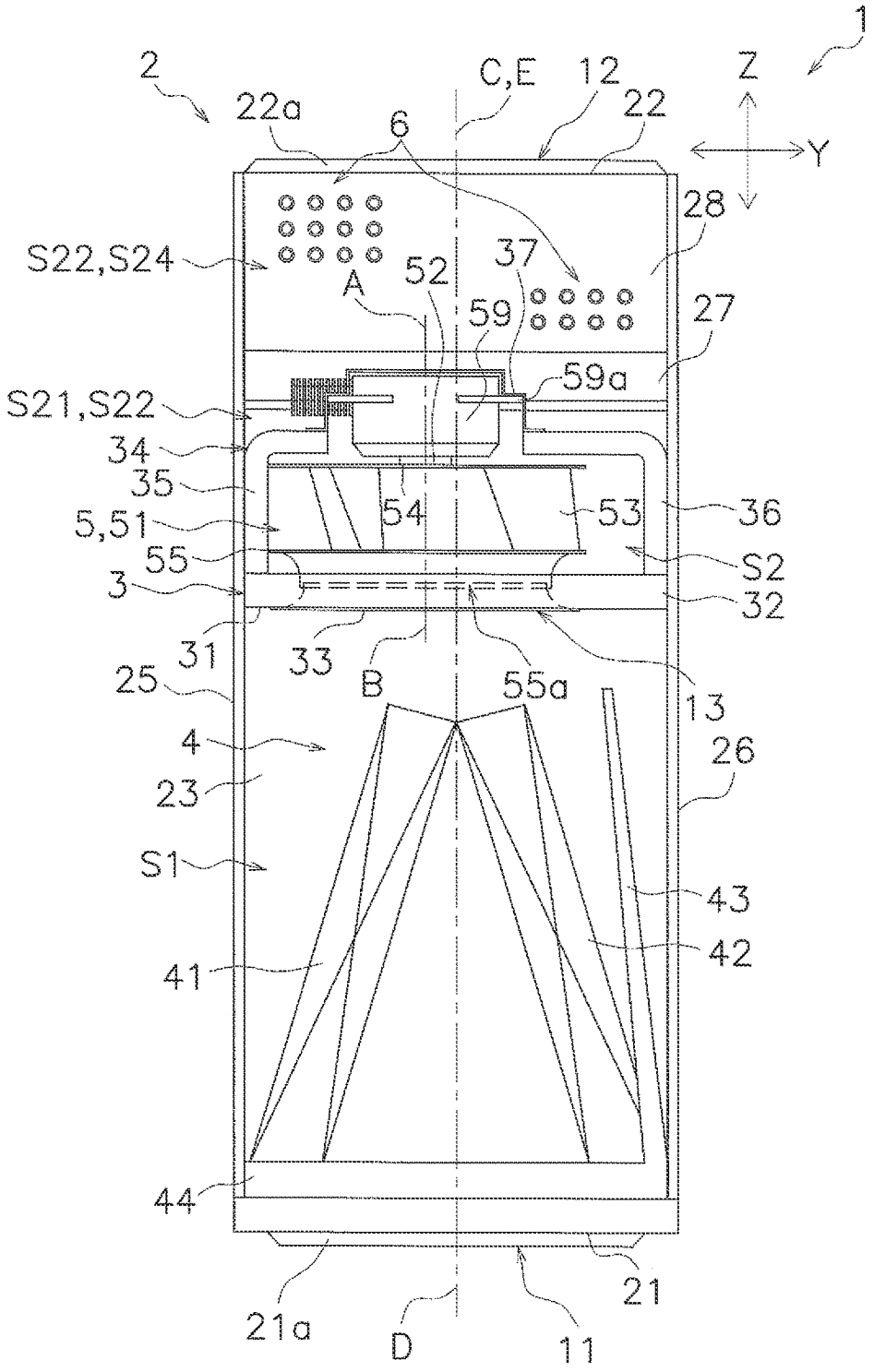
FIG. 3 is a rear lateral view of the air conditioning apparatus from which a second lateral part is detached (in the vertical mount configuration)
Figure 4:
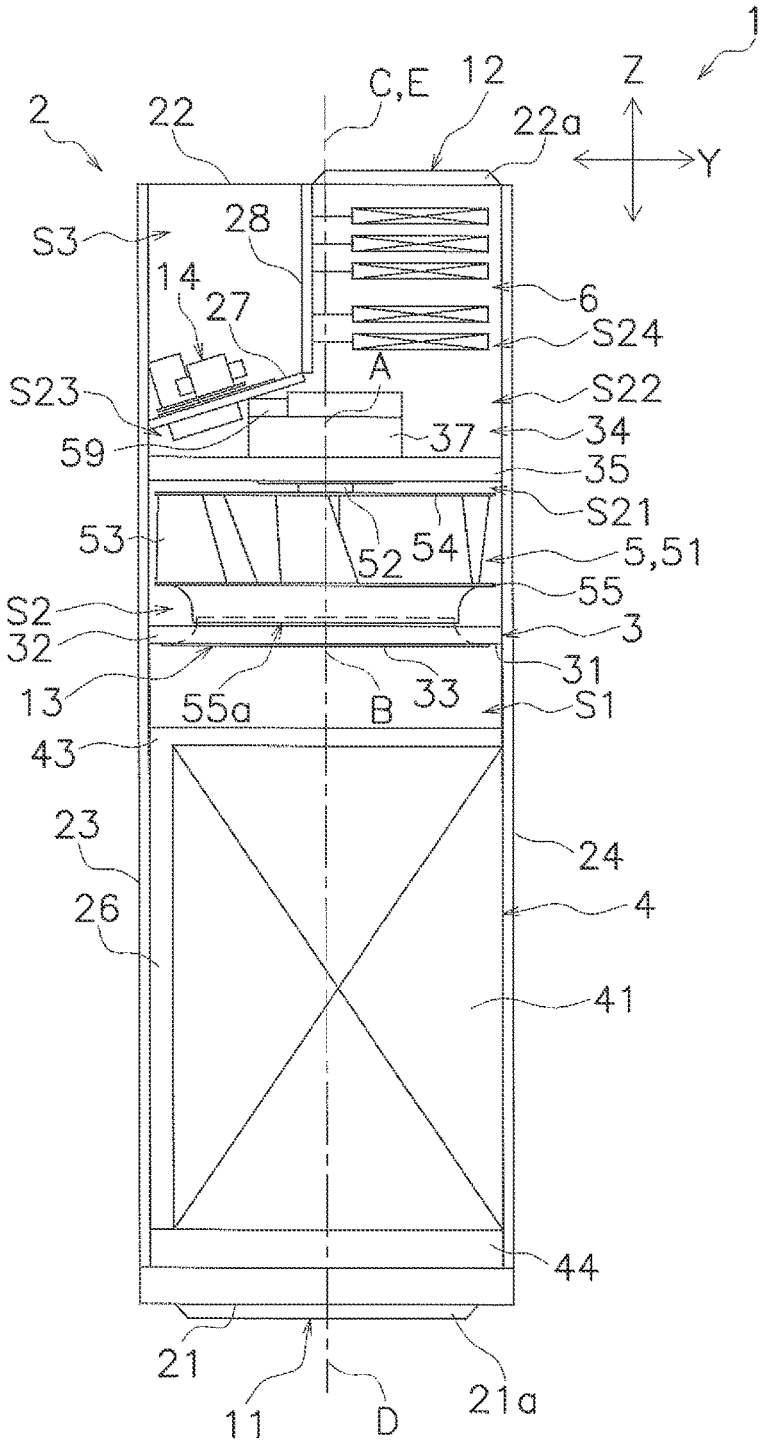
FIG. 4 is a right lateral view of the air conditioning apparatus from which a third lateral part is detached (in the vertical mount configuration)
Figure 5:
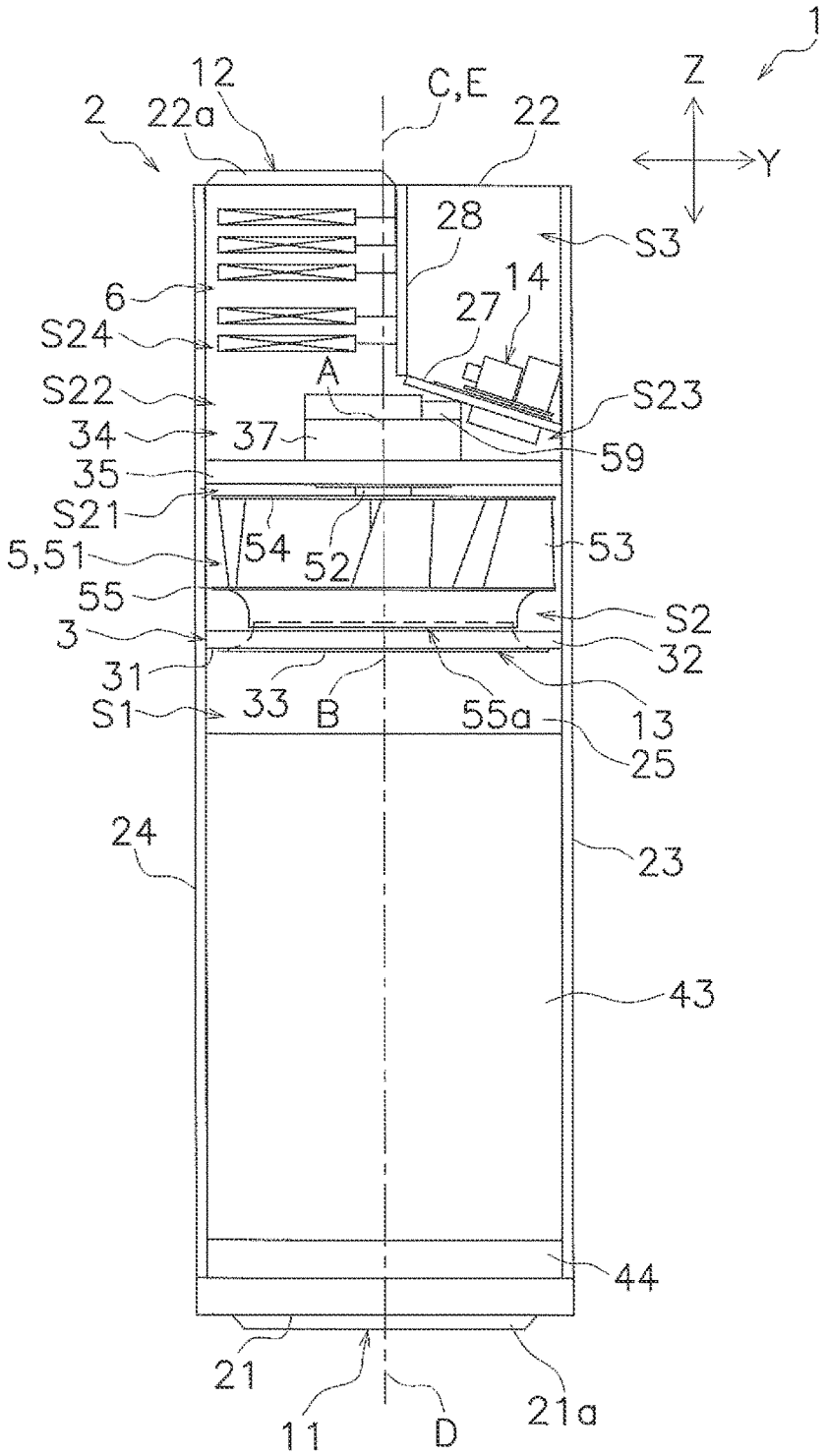
FIG. 5 is a left lateral view of the air conditioning apparatus from which a fourth lateral part is detached (in the vertical mount configuration)
Figure 6:
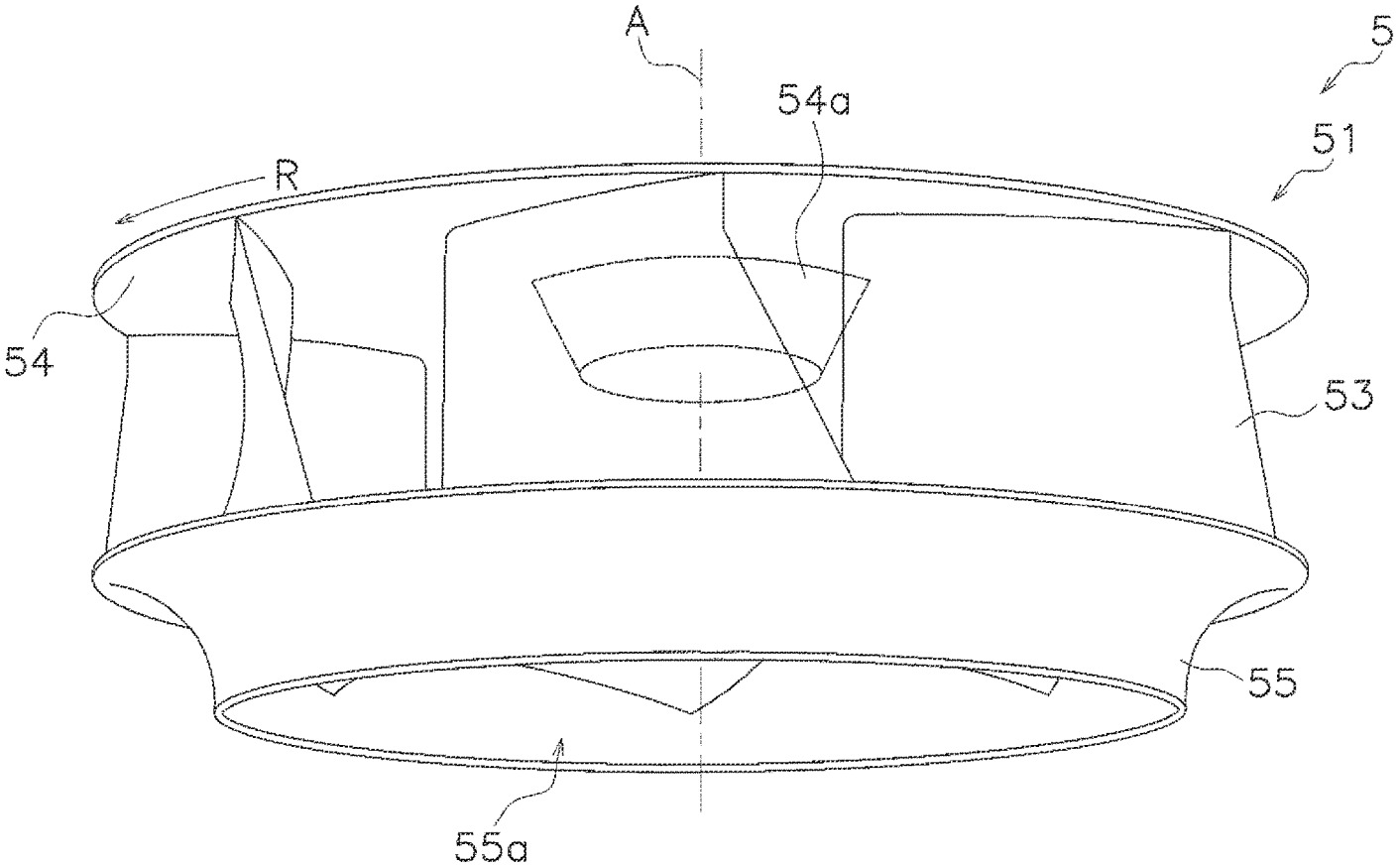
FIG. 6 is an external perspective view of a bladed wheel of a centrifugal fan.
Figure 7:
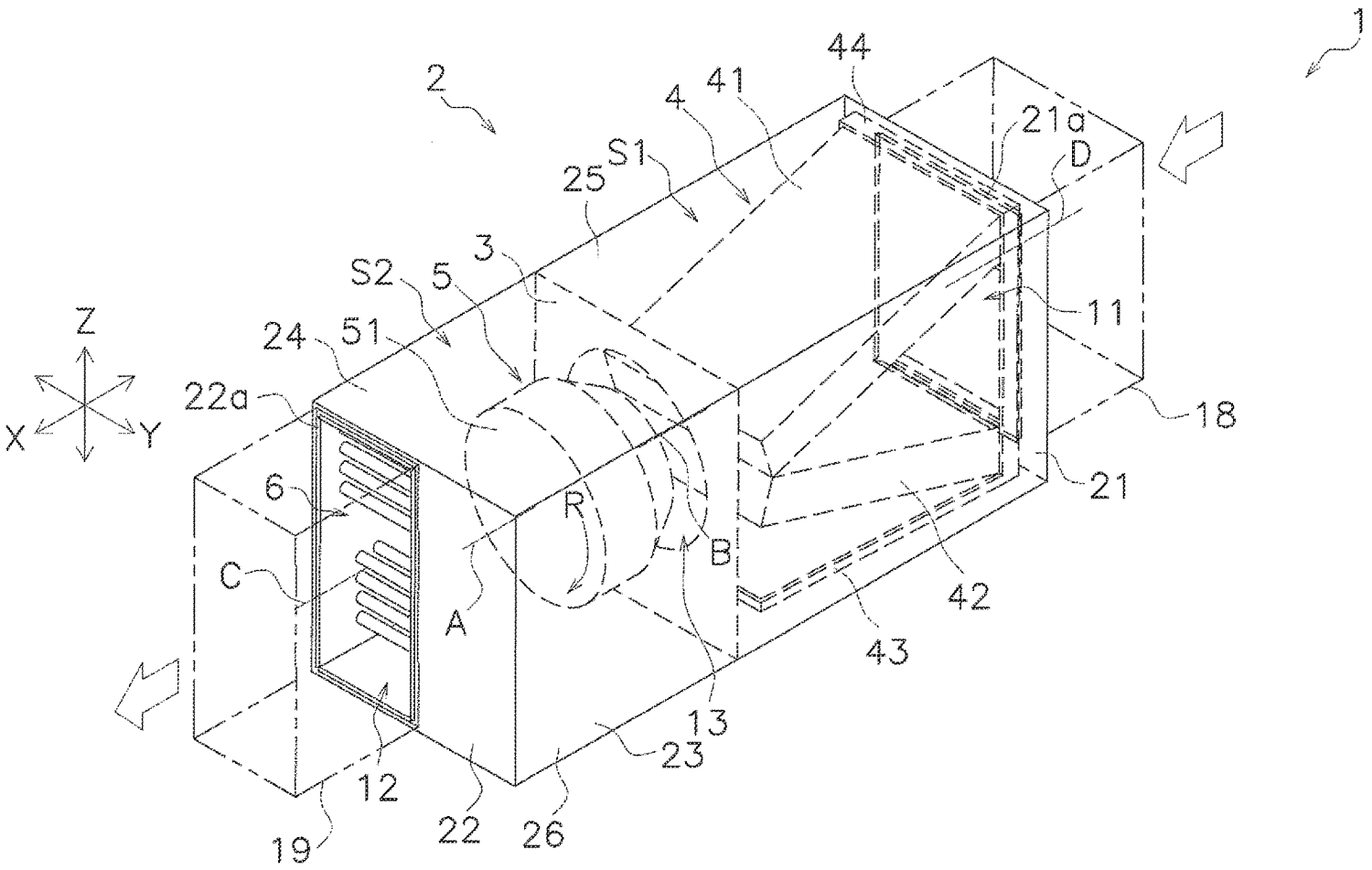
FIG. 7 is an external perspective view of the air conditioning apparatus (in a horizontal mount configuration)
Figure 8:
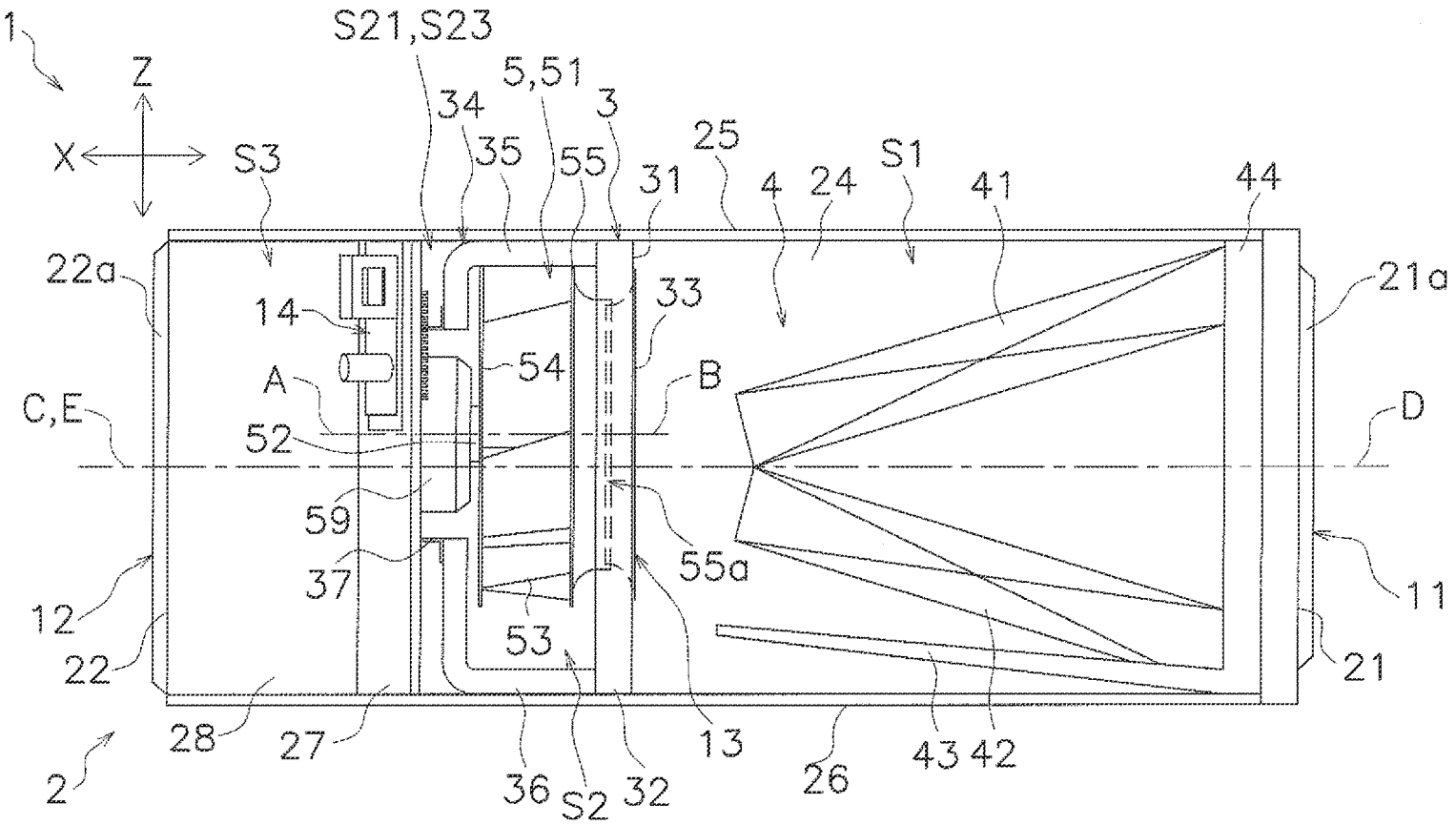
FIG. 8 is a right lateral view of the air conditioning apparatus from which the first lateral part is detached (in the horizontal mount configuration)

First, a basic construction of an air conditioning apparatus 1 will be explained with FIGS. 1 to 8. Here, FIG. 1 is an external perspective view of the air conditioning apparatus 1 according to the preferred embodiment of the present invention (in a vertical mount configuration). FIG. 2 is a front lateral view of the air conditioning apparatus 1 from which a first lateral part 23 is detached (in the vertical mount configuration). FIG. 3 is a rear lateral view of the air conditioning apparatus 1 from which a second lateral part 24 is detached (in the vertical mount configuration). FIG. 4 is a right lateral view of the air conditioning apparatus 1 from which a third lateral part 25 is detached (in the vertical mount configuration). FIG. 5 is a left lateral view of the air conditioning apparatus 1 from which a fourth lateral part 26 is detached (in the vertical mount configuration). FIG. 6 is an external perspective view of a bladed wheel of a centrifugal fan. FIG. 7 is an external perspective view of the air conditioning apparatus 1 (in a horizontal mount configuration). FIG. 8 is a right lateral view of the air conditioning apparatus 1 from which the first lateral part 23 is detached (in the horizontal mount configuration).

The air conditioning apparatus 1 is an apparatus installed in a building in order to perform a cooling operation and a heating operation for the indoor space of the building. The air conditioning apparatus 1 includes a casing 2, a partition member 3, a heat exchanger 4 and a centrifugal fan 5. The casing 2 has an intake port 11 and a blow-out port 12. The partition member 3 divides the interior of the casing 2 into a heat exchanger compartment S1 located on the intake port 11 side and a fan compartment S2 located on the blow-out port 12 side, and has a fan entrance 13 making the heat exchanger compartment S1 and the fan compartment S2 communicate with each other. The heat exchanger 4 is mounted in the heat exchanger compartment S1. The centrifugal fan 5 includes a bladed wheel 51 having a plurality of rearward blades 53 and is configured to suck air existing in the heat exchanger compartment S1 into the fan compartment S2 through the fan entrance 13, with the bladed wheel 51 being mounted in the fan compartment S2 such that a rotary shaft 52 (its axis will be referred to as a rotary axis A) is oriented to an opening direction B of the fan entrance 13.

Moreover, the fan entrance 13 is herein opposed to the blow-out port 12, and the rotary shaft 52 (the rotary axis A) of the bladed wheel 51 is oriented to the opening direction B of the fan entrance 13 and an opening direction C of the blow-out port 12. Furthermore, the intake port 11 is herein opposed to the fan entrance 13, and the rotary shaft 52 (the rotary axis A) of the bladed wheel 51 is oriented to the opening direction B of the fan entrance 13, the opening direction C of the blow-out port 12 and an opening direction D of the intake port 11.

Moreover, the air conditioning apparatus 1 is herein capable of taking two configurations, i.e., the vertical mount configuration and the horizontal mount configuration. In the vertical mount configuration, the casing 2 is disposed such that the rotary shaft 52 (the rotary axis A) of the bladed wheel 51 is oriented to a vertical direction Z (see FIGS. 1 to 5). In the horizontal mount configuration, the casing 2 is disposed such that the rotary shaft 52 (the rotary axis A) of the bladed wheel 51 is oriented to a horizontal direction X (see FIGS. 7 and 8).

As described above, the casing 2 has the intake port 11 and the blow-out port 12. The casing 2 is mainly composed of an upstream lateral part 21, a downstream lateral part 22, the first lateral part 23, the second lateral part 24, the third lateral part 25 and the fourth lateral part 26. These lateral parts 21 to 26 form the elongated cuboid casing 2. The upstream lateral part 21 is a member configured to form the bottom lateral surface of the casing 2 in the vertical mount configuration and form the rear lateral surface of the casing 2 in the horizontal mount configuration. The downstream lateral part 22 is a member configured to form the top lateral surface of the casing 2 in the vertical mount configuration and form the front lateral surface of the casing 2 in the horizontal mount configuration. The upstream lateral part 21 and the downstream lateral part 22 are disposed away from each other in the lengthwise direction of the casing 2 (i.e., a direction along the rotary axis A and the opening directions B, C and D). The upstream lateral part 21 has the intake port 11. The intake port 11 is an opening bored in the middle of the upstream lateral part 21 and is made in the form of a rectangular aperture. The downstream lateral part 22 has the blow-out port 12. The blow-out port 12 is an opening bored in the downstream lateral part 22 so as to be displaced from the middle of the downstream lateral part 22, and is made in the form of a rectangular aperture. The blow-out port 12 is herein located in a position close to the second lateral part 24 within the downstream lateral part 22. The first lateral part 23 is a member configured to form the front lateral surface of the casing 2 in the vertical mount configuration and form the right lateral surface of the casing 2 in the horizontal mount configuration. The second lateral part 24 is a member configured to form the rear lateral surface of the casing 2 in the vertical mount configuration and form the left lateral surface of the casing 2 in the horizontal mount configuration. The first lateral part 23 and the second lateral part 24 are disposed away from each other in a direction orthogonal to the lengthwise direction of the casing 2 (i.e., the horizontal direction X orthogonal to the rotary axis A and the opening directions B, C and D in the vertical mount configuration; a right-and-left direction Y orthogonal to the rotary axis A and the opening directions B, C and D in the horizontal mount configuration). The third lateral part 25 is a member configured to form the right lateral surface of the casing 2 in the vertical mount configuration and form the top lateral surface of the casing 2 in the horizontal mount configuration. The fourth lateral part 26 is a member configured to form the left lateral surface of the casing 2 in the vertical mount configuration and form the bottom lateral surface of the casing 2 in the horizontal mount configuration. The third lateral part 25 and the fourth lateral part 26 are disposed away from each other in a direction orthogonal to the lengthwise direction of the casing 2 (i.e., the right-and-left direction Y orthogonal to the rotary axis A and the opening directions B and C in the vertical mount configuration; the vertical direction Z orthogonal to the rotary axis A and the opening directions B, C and D in the horizontal mount configuration).

Moreover, a plurality of ridges 21*a* are herein formed on the upstream lateral part 21 so as to enclose the circumferential edges of the intake port 11, whereas a plurality of ridges 22*a* are formed on the downstream lateral part 22 so as to enclose the circumferential edges of the blow-out port 12. Furthermore, an intake duct 18 is connected to the intake port 11 through the ridges 21*a*, whereas a blow-out duct 19 is connected to the blow-out port 12 through the ridges 22*a*. With the construction, the air conditioning apparatus 1 is herein configured to be of a duct connection type for sucking and blowing air from and to an air-conditioned room indirectly through the ducts 18 and 19. It should be herein noted that the intake port 11 and the blow-out port 12 are made in forms of rectangular apertures, and likewise, the ducts 18 and 19 are made in forms of rectangular tubes. However, the ports 11 and 12 and the ducts 18 and 19 are not limited to be made in the aforementioned forms, and may employ a variety of forms. Furthermore, the air conditioning apparatus 1 is not limited to be of the duct connection type, and may be of a variety of types such as a type for sucking and blowing air from and to an air-conditioned room directly through the intake port 11 and the blow-out port 12.

As described above, the partition member 3 divides the interior of the casing 2 into the heat exchanger compartment S1 located on the intake port 11 side and the fan compartment S2 located on the blow-out port 12 side, and has the fan entrance 13 that makes the heat exchanger compartment S1 and the fan compartment S2 communicate with each other. The partition member 3 is mainly composed of a partition body 31 made in the form of a rectangular plate. The partition body 31 is disposed in parallel to a direction orthogonal to the lengthwise direction of the casing 2 (i.e., a direction orthogonal to the rotary axis A and the opening directions B, C and D). The fan entrance 13 is bored in the partition body 31 and is herein made in the form of a circular aperture. The partition body 31 has a partition circumferential part 32 made in the form of a rectangular frame. The partition circumferential part 32 extends from the circumferential edges of the partition body 31 toward the fan compartment S2 along the inner surfaces of the lateral parts 23 to 26 of the casing 2.

As described above, the heat exchanger 4 is mounted in the heat exchanger compartment S1. In a cooling operation, the heat exchanger 4 is configured to cool air flowing through the heat exchanger compartment S1 by a refrigerant. Contrarily in a heating operation, the heat exchanger 4 is also capable of heating air flowing through the heat exchanger compartment S1 by the refrigerant. A fin tube heat exchanger, composed of multiple fins and a heat transfer tube, is herein employed as the heat exchanger 4. Furthermore, the refrigerant is configured to be supplied to the heat exchanger 4 from an outdoor unit installed outside the building or so forth. The heat exchanger 4 is composed of a part 41 located closely to the third lateral part 25 of the casing 2 and a part 42 located closely to the fourth lateral part 26 of the casing 2. Moreover, the part 41 of the heat exchanger 4, located closely to the third lateral part 25, is disposed in a tilt position so as to get closer to the third lateral part 25 from a side near to the fan entrance 13 to a side near to the intake port 11. The part 42 of the heat exchanger 4, located closely to the fourth lateral part 26, is disposed in a tilt position so as to get closer to the fourth lateral part 26 from the side near to the fan entrance 13 to the side near to the intake port 11. With the construction, the heat exchanger 4 has a V shape so as to get closer to the third lateral part 25 and the fourth lateral part 26 of the casing 2 from the side near to the fan entrance 13 to the side near to the intake port 11. It should be noted that the heat exchanger 4 is not limited to have the V shape, and may employ a variety of shapes.

Moreover, drain pans 43 and 44 are mounted in the heat exchanger compartment S1 in order to receive water produced by dew condensation in the heat exchanger 4. The first drain pan 43 is configured to be used when the casing 2 is disposed such that the rotary shaft 52 (the rotary axis A) of the bladed wheel 51 is oriented to the horizontal direction X (in the horizontal mount configuration). The second drain pan 44 is configured to be used when the casing 2 is disposed such that the rotary shaft 52 (the rotary axis A) of the bladed wheel 51 is oriented to the vertical direction Z (in the vertical mount configuration). The first drain pan 43 is disposed in a position close to the fourth lateral part 26, which is one of the lateral parts 23 to 26 of the casing 2 that are disposed along the opening direction B of the fan entrance 13. With the construction, the first drain pan 43 is configured to be disposed over the fourth lateral part 26 forming the bottom lateral surface of the casing 2 and receive the bottom side of the heat exchanger 4 in the horizontal mount configuration. The second drain pan 44 is disposed in a position close to the upstream lateral part 21, which is one of the lateral parts 21 and 22 of the casing 2 that are disposed along the direction orthogonal to the opening direction B of the fan entrance 13. With the construction, the second drain pan 44 is configured to be disposed over the upstream lateral part 21 forming the bottom lateral surface of the casing 2 and receive the bottom side of the heat exchanger 4 in the vertical mount configuration. Furthermore, the first and second drain pans 43 and 44 are herein compatible with the vertical mount configuration and the horizontal mount configuration, but the first drain pan 43 to be used in the horizontal mount configuration exists in the heat exchanger compartment S1 even in the vertical mount configuration, whereas the second drain pan 44 to be used in the vertical mount configuration exists in the heat exchanger compartment S1 even in the horizontal mount configuration.

As described above, the centrifugal fan 5 includes the bladed wheel 51 having the plural rearward blades 53 and is configured to suck air existing in the heat exchanger compartment S1 into the fan compartment S2 through the fan entrance 13, with the bladed wheel 51 being mounted in the fan compartment S2 such that the rotary shaft 52 (the rotary axis A) is oriented to the opening direction B of the fan entrance 13. Furthermore, a fan motor 59 is mounted in the fan compartment S2 in order to drive and rotate the bladed wheel 51. Here in the fan compartment 2, the bladed wheel 51 is disposed proximally to the fan entrance 13 and the fan motor 59 is disposed on the downwind side of the bladed wheel 51 along the rotary shaft 52 (the rotary axis A) of the bladed wheel 51. Moreover, a bell mouth 33 is mounted to the fan entrance 13. A space, located on the downwind side of the bladed wheel 51 in the fan compartment S2, is herein defined as a fan downwind space S21. Thus, the fan motor 59 is disposed in the fan downwind space S21.

The bladed wheel 51 is composed of a hub 54, a shroud 55 and the plural rearward blades 53 disposed between the hub 54 and the shroud 55. The hub 54 connects the blow-out port 12 side ends of the plural rearward blades 53, and is configured to be rotated about the rotary shaft 52 (the rotary axis A). The hub 54 is a disc-shaped member and has a hub protrusion 54*a* protruding from its middle toward the shroud 55. The hub protrusion 54*a* is coupled to the fan motor 59. The shroud 55 is disposed on the fan entrance 13 side of the hub 54 so as to be opposed to the hub 54, connects the fan entrance 13 side ends of the plural rearward blades 53, and is configured to be rotated about the rotary shaft 52 (the rotary axis A). The shroud 55 is an annular member and has a fan opening 55*a* that is bored in the form of a circular aperture and is centered at the rotary shaft 52 (the rotary axis A). The shroud 55 has a curved shape that its outer diameter increases toward a side near to the hub 54. The plural rearward blades 53 are disposed between the hub 54 and the shroud 55 so as to be aligned at predetermined intervals along the circumferential direction of the rotary shaft 52 (the rotary axis A). Each rearward blade 53 tilts oppositely to a rotary direction R of the bladed wheel 51 (herein a clockwise direction in a view seen from the blow-out port 12 side) with respect to the radial direction of the hub 54.

The bell mouth 33 is mounted to the fan entrance 13 of the partition member 3 so as to be opposed to the fan opening 55*a* of the bladed wheel 51 and directs air, flowing thereto from the heat exchanger compartment S1, to the fan opening 55*a* of the bladed wheel 51. The bell mouth 33 is an annular member centered at the rotary shaft 52 (the rotary axis A). The bell mouth 33 has a curved shape that its outer diameter decreases toward a side near to the shroud 55.

The fan motor 59 is disposed concentrically to the rotary shaft 52 (the rotary axis A) of the bladed wheel 51 in the fan downwind space S21. The fan motor 59 has a columnar shape centered at the rotary shaft 52 (the rotary axis A). The fan motor 59 is herein fixed to the partition member 3 through a motor support base 34. Specifically, the motor support base 34 is composed of support frames 35 and 36 forming a roughly squared U shape. The support frames 35 and 36 respectively extend toward the vicinity of the outer peripheral surface of the fan motor 59 from parts of the partition circumferential part 32 of the partition member 3. i.e., a part located closely to the third lateral part 25 of the casing 2 and a part located closely to the fourth lateral part 26 of the casing 2. Moreover, the fan motor 59 is fixed at its end plate parts 59*a* to the support frames 35 and 36 through a bracket 37. The end plate parts 59*a* extend from the outer peripheral surface of the fan motor 59 toward the third lateral part 25 and the fourth lateral part 26. Thus, the centrifugal fan 5, including the bladed wheel 51 and the fan motor 59, is designed to be fixed to the partition member 3 through the motor support base 34. With the construction, the entirely of the centrifugal fan 5 is configured to be detachable by detaching the partition member 3 from the casing 2 in performing a maintenance work or so forth.

Moreover, the fan downwind space S21 of the fan compartment S2 has a blow-out port opposed space S22 as a region opposed to the blow-out port 12. The blow-out port 12 is herein disposed in the position close to the second lateral part 24 within the downstream lateral part 22. Thus, when the casing 2 is seen from the blow-out port 12 side, the blow-out port opposed space S22 is formed by a space enclosed by parts located along the circumferential edges of the opening of the blow-out port 12, i.e., the second lateral part 24, a part of the third lateral part 25 that is located closely to the second lateral part 24, and a part of the fourth lateral part 26 that is located closely to the second lateral part 24. Furthermore, a blow-out port non-opposed surface part 27 is mounted in a position on the downwind side of the bladed wheel 51 so as to be opposed to the fan entrance 13, and accordingly, a blow-out port non-opposed space S23 is formed as a space excluding the blow-out port opposed space S22 within the fan downwind space S21 so as not to be opposed to the blow-out port 12 but to be opposed to the blow-out port non-opposed surface part 27. Moreover, a blow-out port circumferential surface part 28 is herein provided so as to extend from the blow-out port 12 side end of the blow-out port non-opposed surface part 27 toward the blow-out port 12 along the opening direction B of the fan entrance 13 and the opening direction C of the blow-out port 12. With the construction, an electric component compartment S3 is herein formed by the blow-out port non-opposed surface part 27, the blow-out port circumferential surface part 28, the first lateral part 23, the third lateral part 25, the fourth lateral part 26, and a part of the downstream lateral part 22 that is located closely to the first lateral part 23 and in which the blow-out port 12 is not formed. The electric component compartment S3 accommodates electric components 14 to be used for controlling devices that make up the air conditioning apparatus 1. Furthermore, a blow-out pathway region S24, having the same opening size as the blow-out port 12, is formed by a region located closely to the blow-out port 12 within the blow-out port opposed space S22, i.e., a space enclosed by the blow-out port circumferential surface part 28, the second lateral part 24, a part of the third lateral part 25 that is located closely to the second lateral part 24, and a part of the fourth lateral part 26 that is located closely to the second lateral part 24.

Moreover, an electric heater 6 is herein mounted in the fan downwind space S21 of the fan compartment S2 in order to heat air blown out to the fan downwind space S21 by the bladed wheel 51 of the centrifugal fan 5. The electric heater 6 is heating means for heating air flowing through the fan compartment S2 in a heating operation. A heating element assembly with coiled electric heating wires is herein employed as the electric heater 6 (heating means). The electric heater 6 (the heating means) is disposed in the blow-out port opposed space S22, i.e., a region opposed to the blow-out port 12 within the fan downwind space S21. More specifically, the electric heater 6 (the heating means) is disposed in the blow-out pathway region S24 close to the blow-out port 12 within the blow-out port opposed space S22. It should be noted that the electric heater 6 (the heating means) is not limited to the heating element assembly with the coiled electric heating wires, and alternatively, may employ a variety of types of heater.

(2) Basic Action of Air Conditioning Apparatus

Next, a basic action of the air conditioning apparatus 1 will be explained with FIGS. 1 to 8.

In the air conditioning apparatus 1 having the aforementioned construction, the bladed wheel 51 of the centrifugal fan 5 is configured to be rotated by driving of the fan motor 59. This produces the flow of air passing through the interior of the casing 2 sequentially in the order of the intake port 11, the heat exchanger compartment S1, the fan entrance 13, the fan compartment S2 and the blow-out port 12.

Now in the cooling operation, air fed to the interior of the casing 2 through the intake port 11 flows into the heat exchanger compartment S1, and is cooled by the refrigerant flowing through the heat exchanger 4. Then, the air cooled by the heat exchanger 4 flows into the fan compartment S2 through the fan entrance 13 and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is fed to the outside of the casing 2 through the blow-out port 12.

On the other hand, in the heating operation, air fed to the interior of the casing 2 through the intake port 11 flows into the heat exchanger compartment S1, and is heated by the refrigerant flowing through the heat exchanger 4. The air heated by the heat exchanger 4 flows into the fan compartment S2 through the fan entrance 13, and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is further heated by the electric heater 6 (the heating means), and is then fed to the outside of the casing 2 through the blow-out port 12.

(3) Construction for Enabling Efficient Heating by Heating Means in Vicinity to Blow-Out Port In the air conditioning apparatus 1 having the aforementioned basic construction, the centrifugal fan 5 having the rearward blades 53 is mounted in the fan compartment 2 having the fan entrance 13 bored in opposition to the blow-out port 12 such that the rotary shaft 52 (the rotary axis A) is oriented to the opening direction B of the fan entrance 13 and the opening direction C of the blow-out port 12, and the electric heater 6 (the heating means) is mounted in the vicinity of the blow-out port 12.

Figure 9:
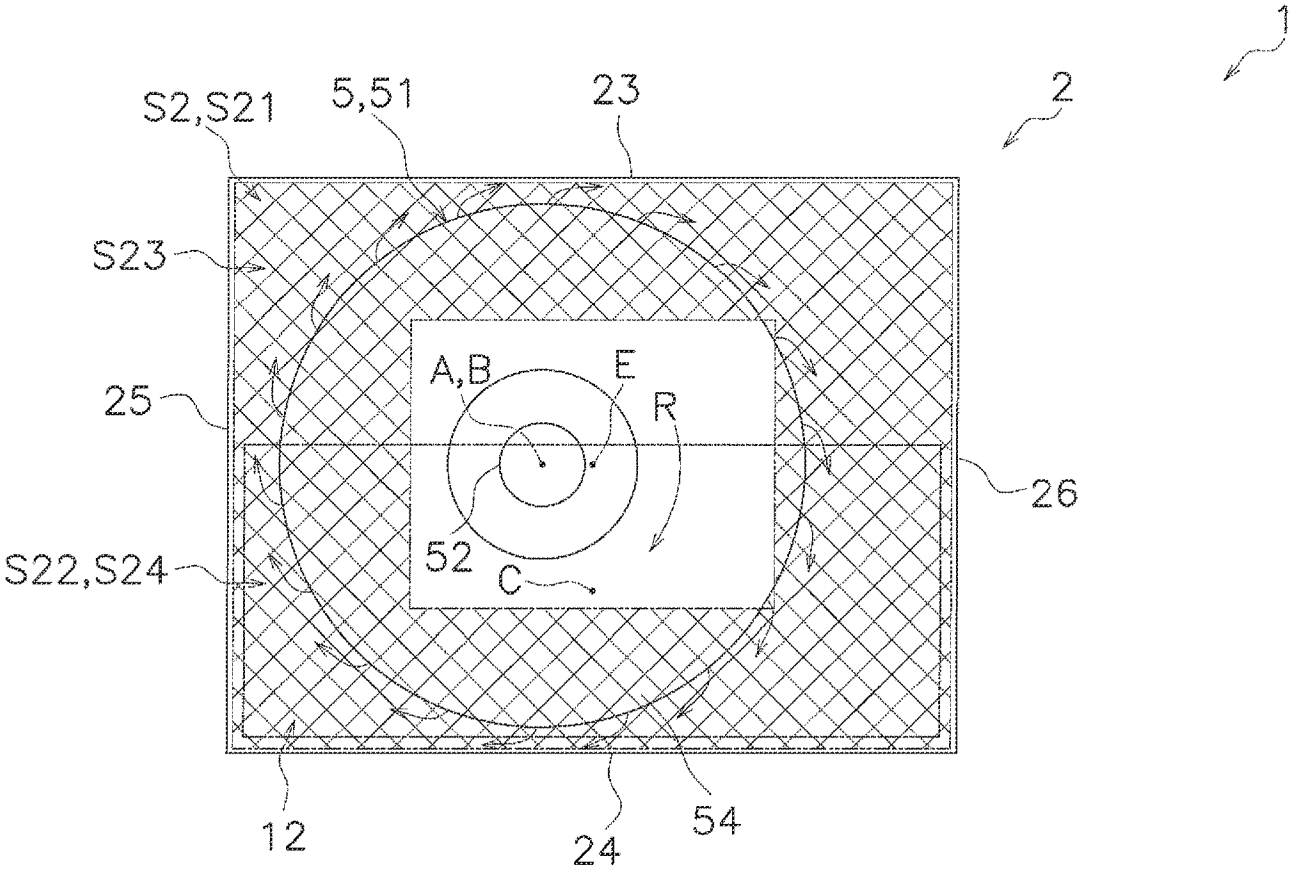
FIG. 9 is a cross-sectional view of FIG. 2 taken along line I-I.
Figure 10:
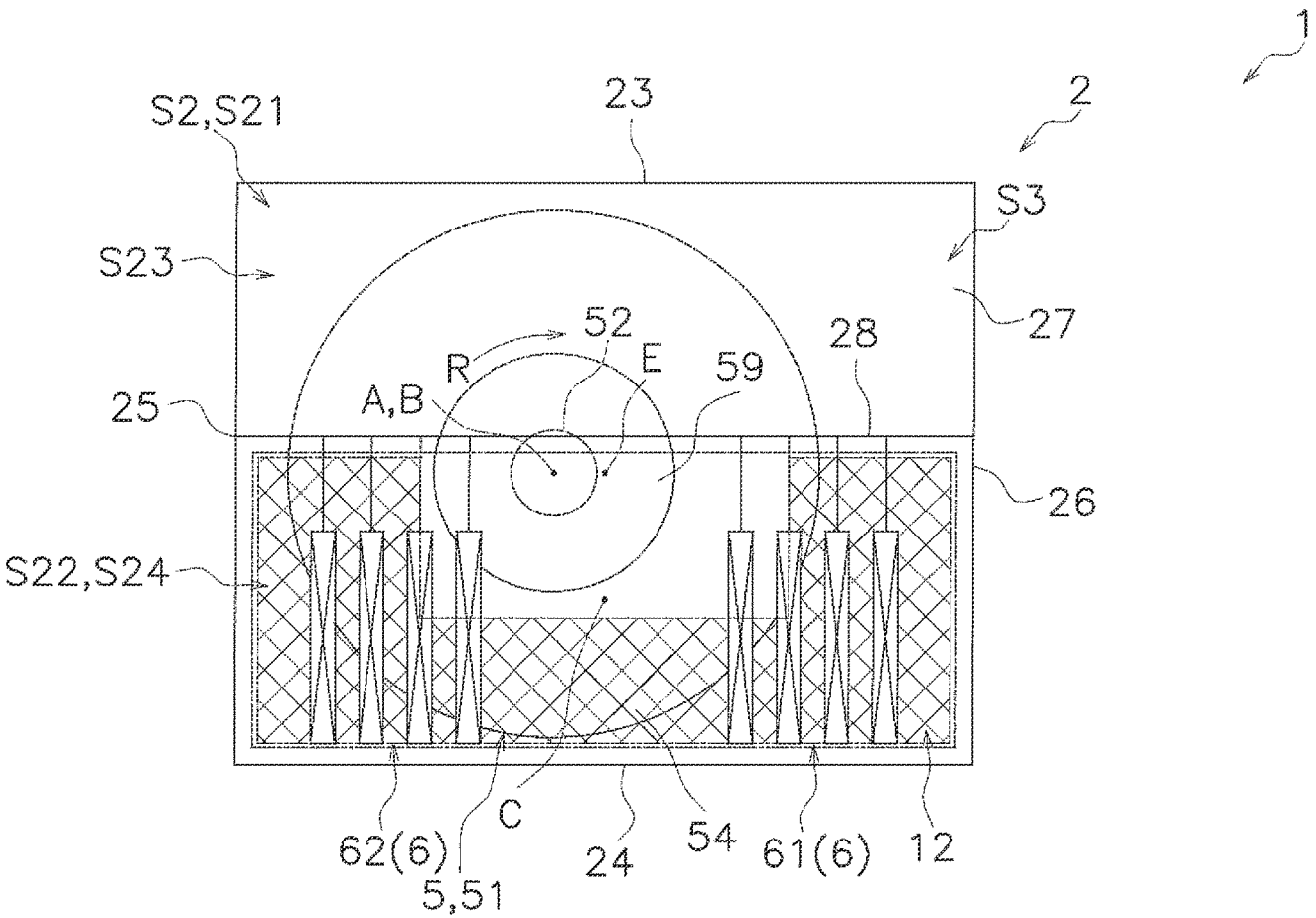
FIG. 10 is a top lateral view of the air conditioning apparatus from which a downstream lateral part is detached (in the vertical mount configuration)

Air blown out by the bladed wheel 51 of the centrifugal fan 5 herein tends to swirl in the rotary direction R of the bladed wheel 51 and simultaneously flow along the circumferential part (i.e., the lateral parts 23 to 26) of the casing 2 when the casing 2 is seen from the direction along the rotary shaft 52 (the rotary axis A) of the centrifugal fan 5 (i.e., the opening direction B of the fan entrance 13 and the opening direction C of the blow-out port 12) (see FIG. 9). Accordingly, air, which is blown out to the outside of the casing 2 from the blow-out port 12 through the blow-out port opposed space S22, also tends to flow along regions close to the circumferential part of the casing 2 when the casing 2 is seen from the direction along the rotary shaft 52 (the rotary axis A) of the centrifugal fan 5 (i.e., the opening direction B of the fan entrance 13 and the opening direction C of the blow-out port 12) (see FIG. 10). FIG. 9 is herein a cross-sectional view of FIG. 2 taken along line I-I, whereas FIG. 10 is a top lateral view of the air conditioning apparatus 1 from which the downstream lateral part 22 is detached (in the vertical mount configuration). Additionally in FIGS. 9 and 10, arrows indicate the flow of air blown out from the bladed wheel 51, whereas cross hatching indicates regions in which air flows at a high speed.

Therefore, it is preferable in the air conditioning apparatus 1 to mount the electric heater 6 (the heating means) in consideration of the aforementioned tendency of airflow from the centrifugal fan 5 and enable efficient heating by the electric heater 6.

In view of the above, the electric heater 6 (the heating means) is herein contrived in positional arrangement. Specifically, when seen from the direction along the rotary shaft 52 (the rotary axis A), the electric heater 6 (the heating means) is disposed in regions close to the circumferential part (i.e., the lateral parts 23 to 26) of the casing 2 within the blow-out port opposed space S22. The electric heater 6 (the heating means) is herein divided into a first electric heater 61 (first heating means) and a second electric heater 62 (second heating means). Furthermore, the first electric heater 61 (the first heating means) is disposed in a region close to the fourth lateral part 26 when seen from the blow-out port 12 side, whereas the second electric heater 62 (the second heating means) is disposed in a region close to the third lateral part 25 when seen from the blow-out port 12 side.

Thus, the electric heater 6 (the heating means) is herein mounted in the blow-out port opposed space S22. Additionally, when seen from the direction along the rotary shaft 52 (the rotary axis A), the electric heater 6 (the heating means) is designed to be disposed in a region close to the circumferential part of the casing 2 within the blow-out port opposed space S22. With the construction, the electric heater 6 (the heating means) is herein interpreted as being mounted in consideration of the tendency that air blown out by the bladed wheel 51 of the centrifugal fan 5 flows along the lateral parts 23 to 26 of the casing 2.

Consequently, efficient heating is herein enabled when the electric heater 6 (the heating means) is mounted in the vicinity of the blow-out port 12.

Moreover, a part of the blow-out port 12 (i.e., a right part of the blow-out port 12 in FIGS. 9 and 10) is herein disposed in a position close to the fourth lateral part 26 (a blow-out port nearby lateral part), which is one of the lateral parts 23 to 26 of the casing 2 that are disposed along the opening direction B of the fan entrance 13 and the opening direction C of the blow-out port 12 (see FIGS. 1, 4, 5, 7, 9, 10 and 11). Put differently, the blow-out port 12 is herein disposed in the downstream lateral part 22 so as to be displaced closely to the second lateral part 24, and accordingly, a part of the blow-out port 12 (i.e., the right part of the blow-out port 12 in FIG. 9) is disposed in a position close to the fourth lateral part 26 (the blow-out port nearby lateral part). Furthermore, the first electric heater 61 (the first heating means), which is one of the heaters composing the electric heater 6 (the heating means), is disposed in a position close to the bladed wheel 51 in a region located on a rearward side in the rotary direction R of the bladed wheel 51 within the blow-out port opposed space S22 (see FIGS. 10 to 12). Put differently, the first electric heater 61 (the first heating means) is herein disposed in the position close to the bladed wheel 51 in the region close to the fourth lateral part 26 within the blow-out port opposed space S22. On the other hand, the second electric heater 62 (the second heating means), which is another of the heaters composing the electric heater 6 (the heating means), is disposed in a position close to the blow-out port 12 in a region located on a forward side in the rotary direction R of the bladed wheel 51 within the blow-out port opposed space S22 (see FIGS. 10 to 12). Put differently, the second electric heater 62 (the second heating means) is herein disposed in the position close to the blow-out port 12 in the region close to the third lateral part 25 within the blow-out port opposed space S22.

Thus, at least a part of the blow-out port 12 is herein designed to be disposed closely to the blow-out port nearby lateral part, and the first electric heater 61 (the first heating means) is designed to be disposed closely to the bladed wheel 51 in the region located on the rearward side in the rotary direction R of the bladed wheel 51 within the blow-out port opposed space S22 whereas the second electric heater 62 (the second heating means) is designed to be disposed closely to the blow-out port 12 in the region located on the forward side in the rotary direction R of the bladed wheel 51 within the blow-out port opposed space S22. Therefore, the first and second electric heaters 61 and 62 (the first and second heating means) are herein interpreted as being mounted in consideration of the swirling airflow in the rotary direction R of the bladed wheel 51. Put differently, air, blown out to the fan downwind space S21 by the bladed wheel 51, flows while swirling in the rotary direction R of the bladed wheel 51. Hence, the air tends to flow and concentrate from the space located on the rearward side in the rotary direction R of the bladed wheel 51 to the space located on the forward side in rotary direction R of the bladed wheel 51 in accordance with proximity to the blow-out port 12. Then in consideration of the aforementioned tendency, the first electric heater 61 (the first heating means) is designed to be disposed closely to the bladed wheel 51 in the region located on the rearward side in the rotary direction R of the bladed wheel 51 within the blow-out port opposed space S22, whereas the second electric heater 61 (the second heating means) is designed to be disposed closely to the blow-out port 12 in the region located on the forward side in the rotary direction R of the bladed wheel 51 within the blow-out port opposed space S22.

Consequently, more efficient heating is herein enabled when the electric heater 6 (the heating means) is mounted in the vicinity of the blow-out port 12.

Figure 11:
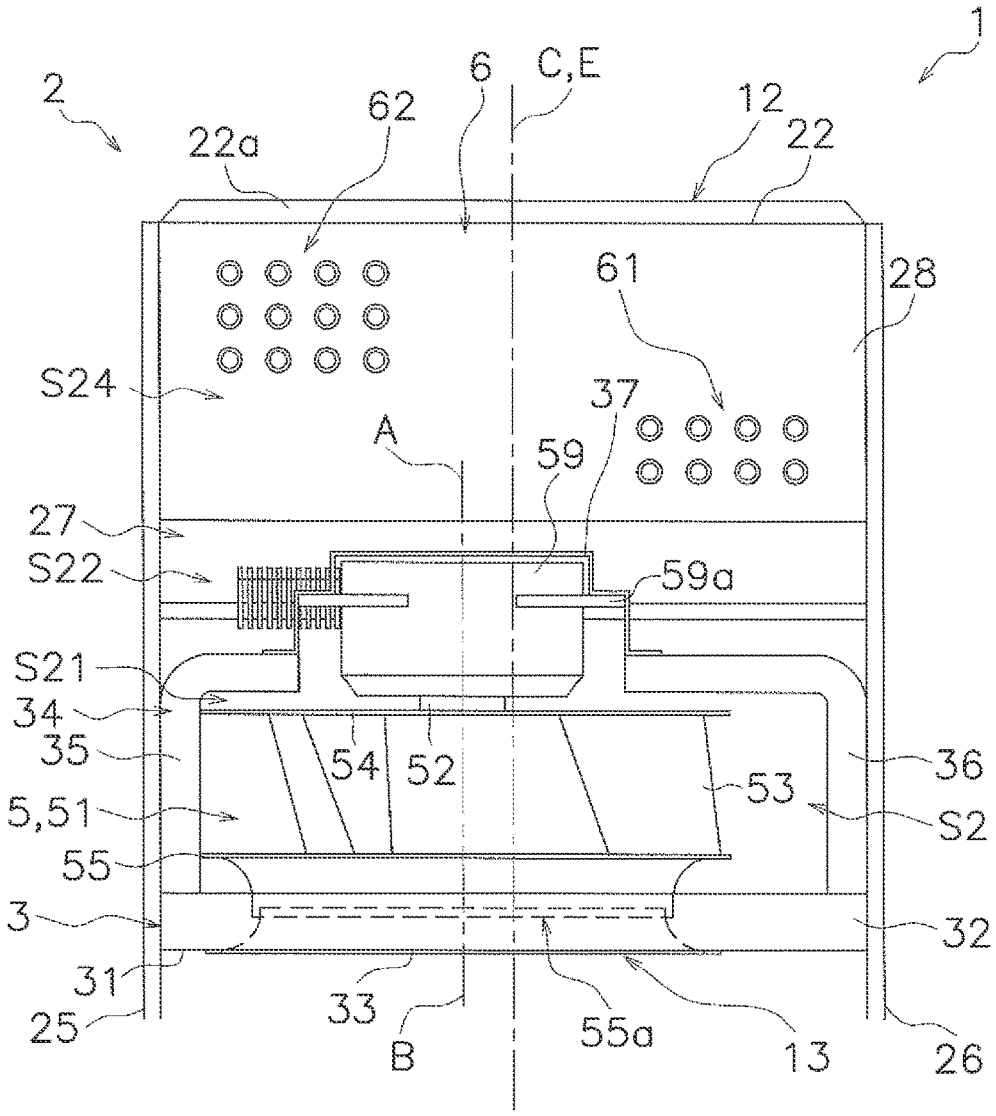
FIG. 11 is an enlarged view of a fan compartment and its vicinity in FIG. 3.
Figure 12:
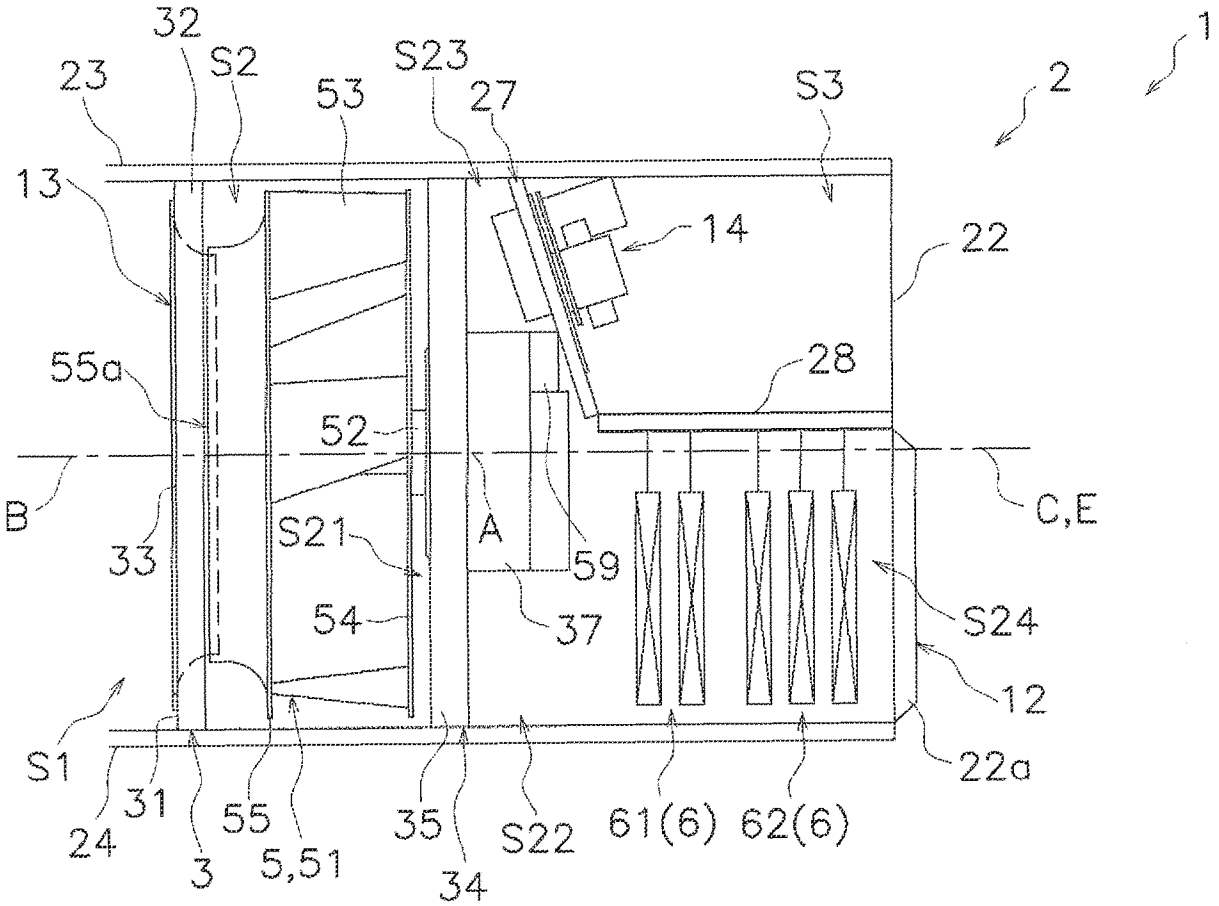
FIG. 12 is an enlarged view of the fan compartment and its vicinity in FIG. 4.

Moreover, the second electric heater 62 (the second heating means) herein has a heating capacity larger than that of the first electric heater 61 (the first heating means) (see FIGS. 10 to 12). Specifically, the heating capacity of the second electric heater 62 (the second heating means) is set to be larger than that of the first electric heater 61 (the first heating means) by setting the number of the heater elements composing the second electric heater 62 (the second heating means) to be larger than that of the heater elements composing the first electric heater 61 (the first heating means).

It should be herein noted that the number of the heater elements composing the second electric heater 62 (the second heating means) is set to be 12, whereas the number of the heater elements composing the first electric heater 61 (the first heating means) is set to be 8. However, the number of the heater elements composing the first electric heater 61 and that of the heater elements composing the second electric heater 62 are not limited to the above, and should be understood as being arbitrarily set in accordance with the sizes of the blow-out port 12 and the blow-out port opposed space S22 and so forth.

Thus, the heating capacity of the second electric heater 62 (the second heating means) is herein set to be larger than that of the first electric heater 61 (the first heating means). Therefore, the respective electric heaters, composing the electric heater 6 (the heating means), are herein designed to be mounted correspondingly to regions for which different heating capacities are suitable, i.e., one region that is located closely to the blow-out port 12 within the blow-out port opposed space S22 and in which air flows at a high flow rate; and another region that is located closely to the bladed wheel 51 within the blow-out port opposed space S22 and in which air flows at a low flow rate. Put differently, due to the swirling flow in the rotary direction R of the bladed wheel 51, air is likely to flow and concentrate from the space located on the rearward side in the rotary direction R of the bladed wheel 51 to the space located on the forward side in the rotary direction R of the bladed wheel 51 in accordance with proximity to the blow-out port 12. Accordingly, the flow rate of air tends to be higher in the space located on the forward side in the rotary direction R of the bladed wheel 51 than in the space located on the rearward side in the rotary direction R of the bladed wheel 51. Then in consideration of the aforementioned tendency, the heating capacity of the second electric heater 62 (the second heating means) disposed in the space located on the forward side in the rotary direction R of the bladed wheel 51 is set to be larger than that of the first electric heater 61 (the first heating means) disposed in the space located on the rearward side in the rotary direction R of the bladed wheel 51.

Consequently, efficient heating is herein enabled in accordance with the flow rate of air when the electric heater 6 (the heating means) is mounted in the vicinity of the blow-out port 12.

Moreover, as described above, the first electric heater 61 (the first heating means), which is one of the electric heaters composing the electric heater 6 (the heating means), is disposed in one position close to the bladed wheel 51 within the blow-out port opposed space S22, whereas the second electric heater 62 (the second heating means), which is the other of the electric heaters composing the electric heater 6 (the heating means), is disposed in another position close to the blow-out port 12 within the blow-out port opposed space S22. As described above, the heating capacity of the second electric heater 62 (the second heating means) is herein set to be larger than that of the first electric heater 61 (the first heating means).

Thus, it can be herein also addressed that the electric heater 6 (the heating means) is mounted in the blow-out port opposed space S22, and specifically, the first electric heater 61 (the first heating means) is disposed in the position close to the bladed wheel 51 within the blow-out port opposed space S22 whereas the second electric heater 62 (the second heating means), having a heating capacity larger than that of the first electric heater 61 (the first heating means), is disposed in the position close to the blow-out port 12 within the blow-out port opposed space S22. Put differently, air, blown out to the fan downwind space S21 by the bladed wheel 51, flows while swirling in the rotary direction R of the bladed wheel 51. The swirling airflow tends to be weakened in accordance with proximity to the blow-out port 12, whereas the straight airflow toward the blow-out port 12 tends to be strengthened. However, from the perspective of heating efficiency by the electric heater 6 (the heating means), a state of airflow strengthened in a straight direction is more preferable than a state of airflow strengthened in a swirling direction. Therefore, it can be also addressed that in consideration of the aforementioned tendency, the respective electric heaters, composing the electric heater 6 (the heating means), are mounted correspondingly to regions for which different heating capacities are suitable, i.e., one region that is located closely to the blow-out port 12 within the blow-out port opposed space S22 and in which the straight airflow is strengthened; and another region that is located closely to the bladed wheel 51 within the blow-out port opposed space S22 and in which the swirling airflow is strengthened.

Consequently, efficient heating is herein enabled when the electric heater 6 (the heating means) is mounted in the vicinity of the blow-out port 12.

The invention claimed is:

1. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along a first axial direction perpendicular to a second lateral direction along which the partition member extends;

a heater mounted in a blow-out port opposed space, the blow-out port opposed space being a region opposed to the blow-out port within a fan downwind space, the fan downwind space being a space located on a downwind side of the bladed wheel within the fan compartment;

an inclined blow-out port non-opposed surface part mounted in a position on the downwind side of the bladed wheel and extending from a first lateral part of the casing; and a blow-out port circumferential surface part extending from a blow-out port side end of the blow-out port non-opposed surface part toward the blow-out port along the first axial direction, with the blow-out port circumferential surface part being spaced from a second lateral part of the casing such that the blow-out port opposed space is disposed on a second lateral part side of the blow-out port circumferential surface part, the heater being disposed in a region adjacent to a circumferential part of the casing within the blow-out port opposed space when seen from a direction along the rotary shaft, the region being closer to the circumferential part of the casing than to a center of the blow-out port opposed space as measured perpendicularly relative to the circumferential part of the casing.

2. An air conditioning apparatus comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along a first axial direction perpendicular to a second lateral direction along which the partition member extends;

a heater mounted in a blow-out port opposed space, the blow-out port opposed space being a region opposed to the blow-out port within a fan downwind space, the fan downwind space being a space located on a downwind side of the bladed wheel within the fan compartment;

an inclined blow-out port non-opposed surface part mounted in a position on the downwind side of the bladed wheel and extending from a first lateral part of the casing; and a blow-out port circumferential surface part extending from a blow-out port side end of the blow-out port non-opposed surface part toward the blow-out port along the first axial direction, with the blow-out port circumferential surface part being spaced from a second lateral part of the casing such that the blow-out port opposed space is disposed on a second lateral part side of the blow-out port circumferential surface part, the heater being disposed in a region adjacent to a circumferential part of the casing within the blow-out port opposed space when seen from a direction along the rotary shaft, the blow-out port being at least partially disposed in a position adjacent to a blow-out port nearby lateral part, the blow-out port nearby lateral part being one of multiple lateral parts of the casing that are disposed along the first axial direction, the heater including a first heater disposed in a first position adjacent to the bladed wheel in a region located on a rearward side in a rotary direction of the bladed wheel within the blow-out port opposed space, the first position being closer to the blow-out port nearby lateral part than to a third lateral part, and the heater including a second heater disposed in a second position adjacent to the blow-out port in a region located on a forward side in the rotary direction of the bladed wheel within the blow-out port opposed space, the second position being closer to the third lateral part than to the blow-out port nearby lateral part.

3. The air conditioning apparatus according to claim 2, wherein the second heater has a heating capacity larger than a heating capacity of the first heater.

4. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along a first axial direction perpendicular to a second lateral direction along which the partition member extends;

a heater mounted in a blow-out port opposed space, the blow-out port opposed space being a region opposed to the blow-out port within a fan downwind space, the fan downwind space being a space located on a downwind side of the bladed wheel within the fan compartment;

an inclined blow-out port non-opposed surface part mounted in a position on the downwind side of the bladed wheel and extending from a first lateral part of the casing; and a blow-out port circumferential surface part extending from a blow-out port side end of the blow-out port non-opposed surface part toward the blow-out port along the first axial direction, with the blow-out port circumferential surface part being spaced from a second lateral part of the casing such that the blow-out port opposed space is disposed on a second lateral part side of the blow-out port circumferential surface part, the heater including a first heater disposed in a first position adjacent to the bladed wheel within the blow-out port opposed space, the first position being closer to the bladed wheel than to the blow-out port, the heater including a second heater disposed in a second position adjacent to the blow-out port within the blow-out port opposed space, the second position being closer to the blow-out port than to the bladed wheel, and the second heater having a heating capacity larger than a heating capacity of the first heater.

* * * * *